US010947761B2

(12) United States Patent
Todd

(10) Patent No.: US 10,947,761 B2
(45) Date of Patent: Mar. 16, 2021

(54) SECURITY DOOR HINGE ASSEMBLY

(71) Applicant: Hodgson Sayers Limited, Durham (GB)

(72) Inventor: Robert Edmund Todd, Northumberland (GB)

(73) Assignee: HODGSON SAYERS LIMITED, Durham (GB)

( * ) Notice: Subject to any disclaimer, the term of this patent is extended or adjusted under 35 U.S.C. 154(b) by 193 days.

(21) Appl. No.: 16/307,431

(22) PCT Filed: Jun. 5, 2017

(86) PCT No.: PCT/GB2017/051606
§ 371 (c)(1),
(2) Date: Dec. 5, 2018

(87) PCT Pub. No.: WO2017/212229
PCT Pub. Date: Dec. 14, 2017

(65) Prior Publication Data

US 2019/0186185 A1 Jun. 20, 2019

(30) Foreign Application Priority Data

Jun. 6, 2016 (GB) ..... 1609830

(51) Int. Cl.
*E05D 11/00* (2006.01)
*E06B 5/11* (2006.01)
(Continued)

(52) U.S. Cl.
CPC ..... *E05D 11/0027* (2013.01); *E05D 5/0215* (2013.01); *E06B 3/822* (2013.01);
(Continued)

(58) Field of Classification Search
CPC .. E05D 11/0027; E05D 11/0018; E06B 5/113; E06B 7/36; E06B 1/08; E06B 1/18; E06B 1/30; E05Y 2800/41
See application file for complete search history.

(56) References Cited

U.S. PATENT DOCUMENTS 1,326,841 A * 12/1919 Bousquet ..... E05F 1/16 16/78
1,925,817 A * 9/1933 Plym ..... E06B 1/366 49/383
(Continued)

FOREIGN PATENT DOCUMENTS

CN 2289869 Y 9/1998
CN 202706736 U 1/2013
(Continued)

OTHER PUBLICATIONS

Loss Prevention Standard, LPS 1175: Issue 7.3, "Requirements and testing procedures for the LPCB approval and listing of intruder resistant buiding components, strongpoints, security enclosures and free-standing barriers," LPCB, BRE Global Ltd., Sep. 2015, 32 pages.
(Continued)

*Primary Examiner* — Justin B Rephann
(74) *Attorney, Agent, or Firm* — Workman Nydegger

(57) ABSTRACT

A security door hinge assembly is provided, comprising a door frame structure, having at least a head member, a first jamb member and a second jamb member, and at least one door leaf. The door leaf further comprises a leaf frame structure, having at least a top rail member, a bottom rail member, a hinge stile member and a lock stile member; an inner leaf panel, mounted to a first side of said leaf frame structure and extending past said hinge stile member, so as to form an inner leaf flange; an outer leaf panel, mounted to a second side of said leaf frame structure, opposite said first
(Continued)

side, and extending past said hinge stile member, so as to form an outer leaf flange, and wherein, in use, said door leaf is operable between a first closed position and a second open position. The security door hinge assembly further comprises a hinge chamber positioned between said first jamb member and said hinge stile; a hinge-mount bracket, coupled to said first jamb member; a hinge mechanism, having at least one pivot axis and which is located within said open hinge chamber and adapted to pivotally mount said door leaf to said hinge-mount bracket, and wherein, in said first closed position, said inner leaf flange is in an exteriorly overlapping engagement with at least a portion of said hinge mount bracket, so as to prevent access to said hinge mechanism.

11 Claims, 5 Drawing Sheets

(51) Int. Cl.
*E06B 3/82* (2006.01)
*E05D 5/02* (2006.01)

(52) U.S. Cl.
CPC ..... *E06B 5/113* (2013.01); *E05D 2011/0036* (2013.01); *E05Y 2600/41* (2013.01); *E05Y 2900/132* (2013.01)

(56) References Cited

U.S. PATENT DOCUMENTS

| | | | | | |
|---|---|---|---|---|---|
| 2,284,320 | A * | 5/1942 | Howe | B60J 5/0495 | 16/250 |
| 2,557,716 | A * | 6/1951 | Allee | E05D 11/00 | 16/250 |
| 2,597,174 | A * | 5/1952 | Patton | E05D 3/02 | 49/398 |
| 3,774,360 | A * | 11/1973 | Hubbard | E06B 3/08 | 52/127.12 |
| 4,186,460 | A * | 2/1980 | Artman | E05D 11/06 | 16/274 |
| 4,290,233 | A * | 9/1981 | Hubbard | E06B 7/362 | 49/383 |
| 8,955,254 | B1 * | 2/2015 | Ewoldt | E06B 3/72 | 49/62 |
| 2008/0040976 | A1 * | 2/2008 | Salzer | E06B 5/113 | 49/50 |
| 2010/0313484 | A1 * | 12/2010 | Boyer | E06B 7/36 | 49/399 |
| 2015/0204134 | A1 * | 7/2015 | Wong | E06B 3/88 | 49/506 |
| 2019/0383075 | A1 * | 12/2019 | Shin | E05D 11/0054 | |

FOREIGN PATENT DOCUMENTS

| | | | |
|---|---|---|---|
| CN | 203175234 | U | 9/2013 |
| CN | 204457329 | U | 7/2015 |
| GB | 2247269 | A | 2/1992 |
| GB | 2259932 | A | 3/1993 |
| WO | WO-2014193142 | A2 | 12/2014 |

OTHER PUBLICATIONS

Rémondot, Xavier, "International Search Report," prepared for PCT/GB2017/051606, dated Aug. 17, 2017, four pages.

* cited by examiner

SECURITY DOOR HINGE ASSEMBLY

The present invention relates to security doors and in particular to security door hinges. Even more particular, the present invention relates to a security door hinge assembly having hinges that are concealed and inaccessible when the security door is closed and during operation of the security door.

INTRODUCTION

Estate security is expensive to implement and maintain across a large regional or national geographic area, often because the dynamics of the threat can be locally influenced.

Threats are dynamic, thus frequently making existing security systems redundant before the capital expenditure has been amortized. Consequently, sites at heightened risk remain exposed for longer then necessary due to the natural reluctance to discard existing costly security equipment and replace it, so as to allow protection against the new threat.

Furthermore, nowadays, any type of information is instantly accessible via Internet based search engines and anybody can make themselves more familiar with suitable attack methods in order to try and gain access into secured premises and sites under risk may be forced to constantly improve and/or replace their security systems.

BRE Group, for example, provides correct specifications of approved security systems and products, which are put under rigorous testing programmes (LPCB approved) that evaluate their ability to both resist deliberate attacks and to operate reliably throughout their service lives. The so called Loss Prevention Standard LPS 1175 is one of the key security standards used for forced entry testing. The LPS 1175 test stipulates the allowable toolset and minimum time at each security rating level to prevent forcible entry through a building element (e.g. door, window etc.). The current security ratings are:

SR1: Opportunist attack by bodily force using minimal tools (e.g. screwdriver, knife, pliers etc.). Maximum work time: 1 minute; maximum test duration: 10 min SR2: More determined opportunist attack with tools of a higher mechanical advantage (e.g. SR1 tools plus bolt cutters, claw hammer, drill etc.). Maximum work time: 3 minute; maximum test duration: 15 min SR3: Deliberate forced entry of protected premises using bodily force and a selection of attack options (e.g. SR2 tools plus short axe, chisel, crowbar, gas torch etc.). Maximum work time: 5 minute; maximum test duration: 20 min SR4: Experienced attempts at forced entry with higher tool levels (e.g. SR3 tools plus felling axe, sledgehammer, steel wedges, disc grinder, jigsaw etc.). Maximum work time: 10 minute; maximum test duration: 30 min SR5: Serious attempt at forced entry with top end battery powered tools used by fire and rescue teams (e.g. SR4 tools plus circular saw, reciprocating saw), i.e. using state of the art cutting tools. Maximum work time: 10 minute; maximum test duration: 30 min In order to achieve a higher security rating, it is very common to simply replace the existing design with the same design but using thicker and more "exotic" materials, though, those "high-end" products are usually much more expensive than the replaced "lower-end" product.

It is known that hinges are usually a weak point of a security door system, because the hinge action requires sufficient space to allow for full movement of the door(s). Consequently, a gap usually exists between the door leaf(s) and frame structure providing an ideal starting point for an attack. Sometime, hinges may be hidden on one side of the door(s) when the door is in a closed position. However, currently available hinge assemblies will still be vulnerable to an attack from a different location and/or different 'angles'.

Accordingly, it is an object of the present invention to provide a security door hinge assembly that is adapted to completely hide or conceal the hinge(s) when viewed from both sides (i.e. front and back) when the door is closed. Furthermore, it is an object of the present invention to provide a security door hinge assembly that is capable of concealing the hinge(s) at least from one side (e.g. front) during operation of the door(s). In addition, it is an object of the present invention to provide a security door hinge assembly with restricted accessibility so as to improve overall security.

SUMMARY OF THE INVENTION

Preferred embodiment(s) of the invention seek to overcome one or more of the above disadvantages of the prior art.

According to a first embodiment of the invention there is provided a security door hinge assembly, comprising:

- a door frame structure, having at least a head member, a first jamb member and a second jamb member;
- at least one door leaf, comprising:
  - a leaf frame structure, having at least a top rail member, a bottom rail member, a hinge stile member and a second stile member which may be a lock stile member;
  - an inner leaf panel, mounted to a first side of said leaf frame structure and extending past said hinge stile member, so as to form an inner leaf flange;
  - an outer leaf panel, mounted to a second side of said leaf frame structure, opposite said first side, and extending past said hinge stile member, so as to form an outer leaf flange, and
  - wherein, in use, said door leaf is operable between a first closed position and a second open position;
- a hinge chamber positioned between said first jamb member and said hinge stile;
- a hinge-mount bracket, coupled to said first jamb member;
- a hinge mechanism, having at least one pivot axis and which is located within said hinge chamber and adapted to pivotally mount said door leaf to said hinge-mount bracket, and
- wherein, in said first closed position, said inner leaf flange is in an exteriorly overlapping engagement with at least a portion of said hinge mount bracket, so as to prevent access to said hinge mechanism.

The hinge chamber may be open or closed.

In a possible embodiment, the assembly comprises at least one body panel, mounted to said first jamb member and extending past said first jamb member, so as to form a body panel flange.

In a possible embodiment, the hinge-mount bracket is coupled to said first jamb member, so as to form an open or closed hinge chamber in conjunction with said body panel flange between said first jamb member and said hinge stile.

In a possible embodiment, the assembly is configured such that in said first closed position, said outer leaf flange is in an interiorly overlapping engagement with said body panel flange and said inner leaf flange is in an exteriorly overlapping engagement with at least a portion of said hinge mount bracket, so as to prevent access to said hinge mechanism.

Thus, in a more complete embodiment there is provided a security door hinge assembly, comprising:

a door frame structure, having at least a head member, a first jamb member and a second jamb member;

at least one door leaf, comprising:

a leaf frame structure, having at least a top rail member, a bottom rail member, a hinge stile member and a second stile member which may be a lock stile member;

an inner leaf panel, mounted to a first side of said leaf frame structure and extending past said hinge stile member, so as to form an inner leaf flange;

an outer leaf panel, mounted to a second side of said leaf frame structure, opposite said first side, and extending past said hinge stile member, so as to form an outer leaf flange, and wherein, in use, said door leaf is operable between a first closed position and a second open position;

at least one body panel, mounted to said first jamb member and extending past said first jamb member, so as to form a body panel flange;

a hinge-mount bracket, coupled to said first jamb member, so as to form an open or closed hinge chamber in conjunction with said body panel flange between said first jamb member and said hinge stile;

a hinge mechanism, having at least one pivot axis and which is located within said open or closed hinge chamber and adapted to pivotally mount said door leaf to said hinge-mount bracket, and wherein, in said first closed position, said outer leaf flange is in an interiorly overlapping engagement with said body panel flange and said inner leaf flange is in an exteriorly overlapping engagement with at least a portion of said hinge mount bracket, so as to prevent access to said hinge mechanism.

This provides the advantage that the hinge assembly is completely hidden or concealed with the door(s) is/are in a closed position when viewed from either side (outer face or inner face of the door). In addition, the invention of the present application provides the advantage that accessibility to the hinge assembly is prevented, or at least restricted from both sides of the door (inner face and outer face), during operation of the door(s) (i.e. opening and closing).

The hinge configuration is thereby capable of manipulating a door that is significantly larger than the opening into which it is intended to fit in such a way that the door engages with and 'wraps around' the frame. The hinge security is further enhanced as the hinge itself becomes effectively redundant when the door is in the closed position. Further to this the overall security of the door-set is greatly increased by virtue of the fact that the hinge is also inaccessible when the door is in the closed position thereby effectively eliminating the hinge as a point of attack.

Advantageously, said body panel may be arranged in a first plane defined by a lateral outer surface of said door frame structure. Preferably, said outer leaf panel and extending outer leaf flange may be arranged in a second plane that is parallel to and inwardly offset from said first plane.

Advantageously, said security door hinge assembly may further comprise a door leaf support bracket that is operably coupled to said leaf frame structure and said inner leaf flange, and which is adapted to structurally support said inner leaf flange.

Preferably, said hinge mechanism may be operably coupled to said leaf frame structure via said door leaf support bracket.

Advantageously, said outer leaf flange may be adapted to freely move within said open or closed hinge chamber when the door leaf is moved between said first closed position and said second open position. Even more advantageously, said outer leaf flange may have a length that is sufficient to continually conceal said hinge mechanism, when said door leaf is moved between said first closed position and said second open position.

Advantageously, said at least one pivot axis of said hinge mechanism may be located substantially in said second plane of said outer leaf flange.

Alternatively, said at least one pivot axis of said hinge mechanism may be located in a plane adjacent to said second plane. In another alternative embodiment, said at least one pivot axis of said hinge mechanism may be located in a plane parallel to and exteriorly offset from said second plane.

Alternatively, said body panel flange, said outer leaf flange and said inner leaf flange may be separate members, said body panel flange may be operably mountable to said first and second jamb member, and each one of said outer and inner leaf flange may be operably mountable to a respective side of said leaf frame structure.

BRIEF DESCRIPTION OF THE DRAWINGS

Preferred embodiments of the present invention will now be described, by way of example only and not in any Limitative sense, with reference to the accompanying drawings, in which.

DETAILED DESCRIPTION OF THE PREFERRED EMBODIMENT(S)

The exemplary embodiment(s) of this invention will be described in relation to a hinge assembly for security doors and in particular a double-door security door system. However, it should be appreciated that, in general, the concealment characteristics of the hinge assembly of the present invention will work equally well with any other door, flap, gate or any other pivotably arranged closure member.

Figure 1:
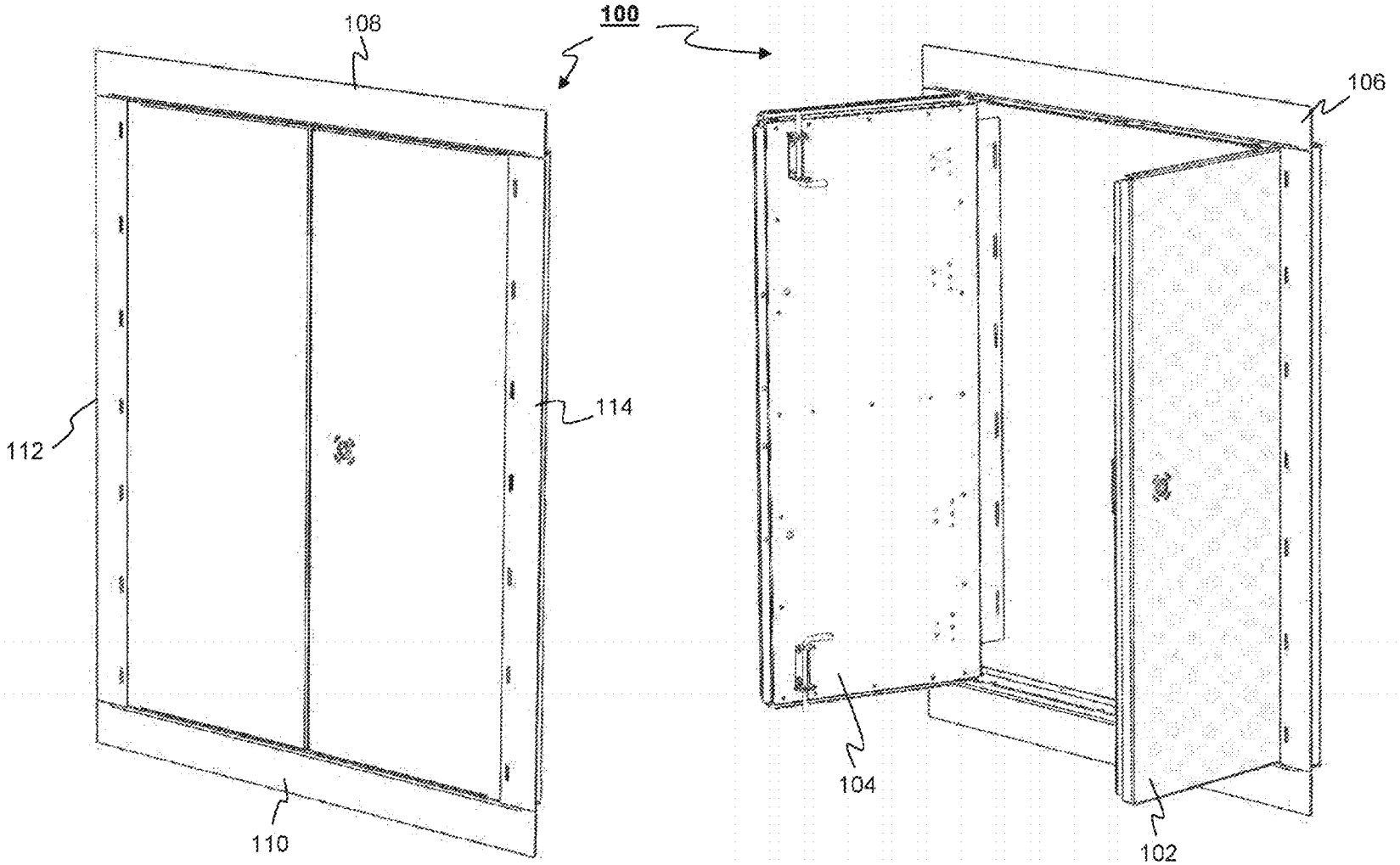
FIG. 1 shows an example of a security door system having a hinge assembly of the present invention including active and inactive door leaf assembly from (a) outside view when closed, and (b) outside view when opened.

Referring now to FIG. 1, a security door system 100 comprising the concealed hinge assembly (not shown) is shown in (a) a closed position as seen from the outside and (b) an open position as seen from the outside (i.e. outside the premises). In this particular example embodiment, the security door system 100 is a double-door set having an active door leaf assembly 102 and an inactive door leaf assembly 104, and a frame structure 106 that comprises a head member 108, a sill member 110 and two jamb members 112 and 114. The frame structure 106 may be fitted within a rebate of a wall of a building structure (not shown). In one particular example, the frame fixings (not shown) may be located to the inside of the building structure, so that any attack would have to start with significant amounts of cutting and drilling to simply gain access to the fixings, i.e. the fixing bolts are even further removed from the attack face. Furthermore, a fascia plate or body plate may be used at the front (outside) of the frame structure 106 to prevent access to the wall fixings, and make good any potential physical deficiencies (e.g. gaps, broken brickwork and lintels) in the wall structure of the building into which the security door system 100 is being fitted. In the embodiment of FIG. 1 a fascia plate or body plate having such function is in effect formed by the front plate of the parts labelled 108, 110 112 &114. This covers the edge of the brickwork that is normally exposed and usually has to be made good prior to fitting a new security door.

Figure 5:
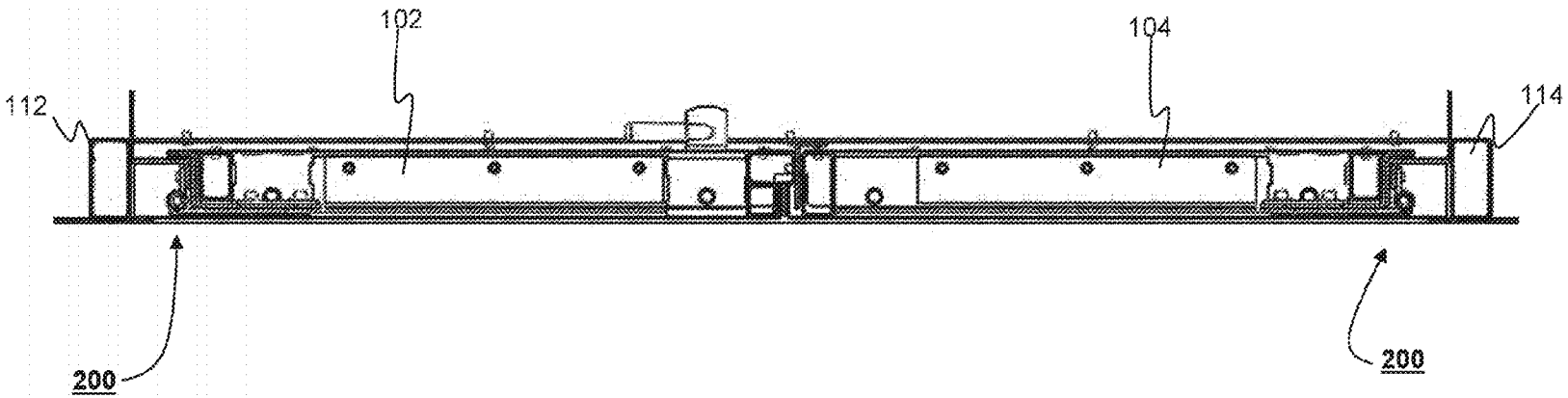
FIG. 5 shows a cross section top-view of a security door assembly, including the frame structure, hinge assemblies, and two door leaf assemblies in a closed position.

A particular reason for concealing the hinge may be considered in the context of the SR ratings above. A conventional solution to obtain a higher SR rating for a hinge might be as noted above to use the same design but with thicker and more "exotic" or otherwise more attack-resistant materials. The invention makes use of the principle that materials is that if something is protected from attack in the first place then the need to use exotic materials or particular designs to withstand an attack is diminished. The result is that the hinge can be cheap enough to remain cost effective at what might otherwise be SR2 level while still being viable at SR5. Additional resistance to the attack may be provided at the higher SR levels by progressively increasing the protection afforded to the hinge by the door itself by virtue of thicker/additional door materials and design features associated with the door. Indeed it could be pointed out that even if the hinge were to be defeated or even removed altogether then the doors would still not be openable without first unlocking the doors themselves as the closed door dimensions become bigger than the door frame opening into which they are fitted as shown for example in FIGS. 2 & 5 below.

Figure 2:
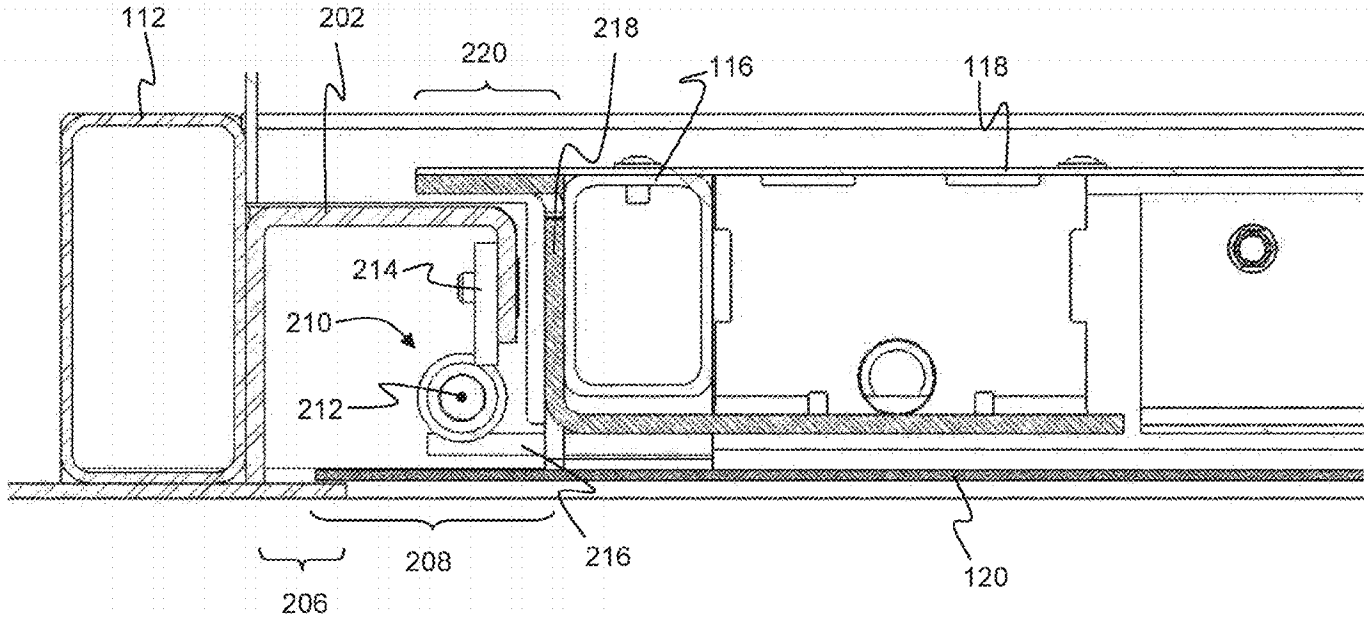
FIG. 2 shows a cross-section top-view of a portion of the frame structure, hinge assembly and door leaf in a closed position.
Figure 3:
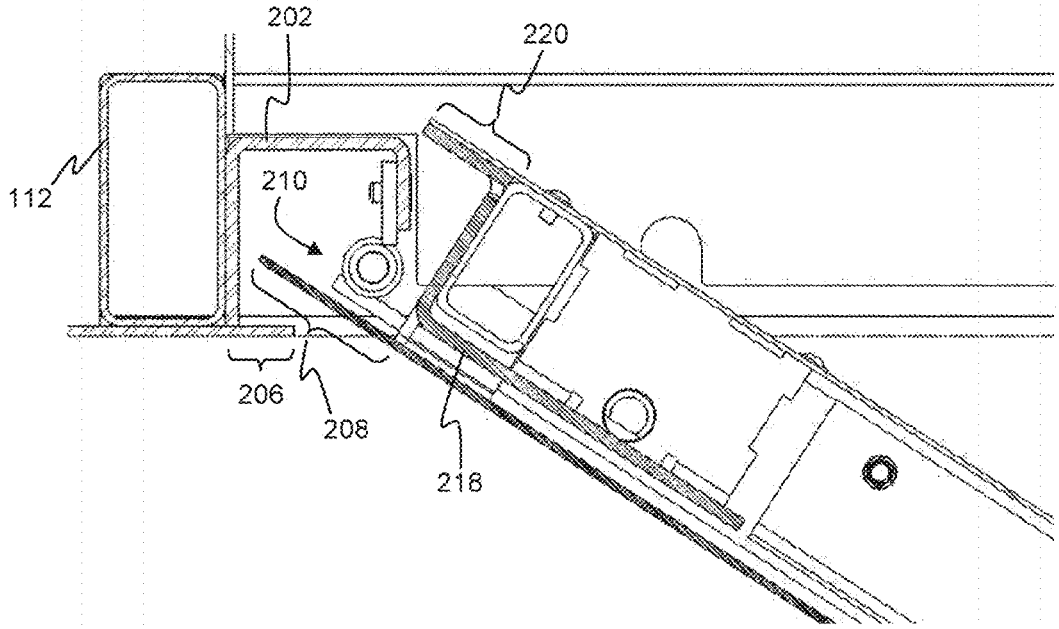
FIG. 3 shows a cross-section top-view of a portion of the frame structure, hinge assembly and door leaf in a half-open position.
Figure 4:
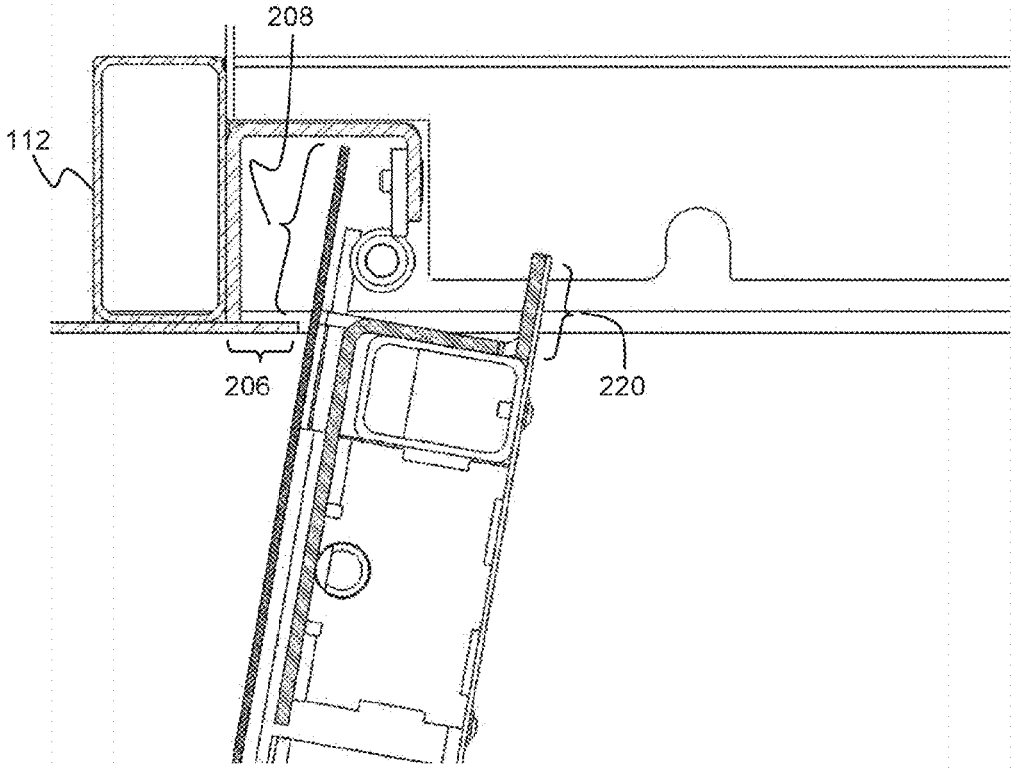
FIG. 4 shows a cross-section top-view of a portion of the frame structure, hinge assembly and door leaf in a fully-open position.

Referring now to FIGS. 2, 3, 4, a close-up cross-section of an embodiment of the hinge assembly 200 is shown in situ when used with a security door system 100. The hinge assembly 200 comprises a hinge-mount bracket 202 that is coupleable to a first jamb member 112 of a door frame structure 106, and that is adapted to form an open hinge chamber 204 in conjunction with a body panel flange 206 and an outer door leaf panel flange 208 between the first jamb member 112, 114 and a hinge stile 116 of a door leaf assembly 102, 104. Furthermore, the hinge assembly 200 comprises a hinge mechanism 210 having a first hinge leaf 214 and a second hinge leaf 216 adapted to rotate relative to each other about at least one common pivot axis 212. The first hinge leaf 214 is mounted to the hinge mount bracket 202 and the second hinge leaf 216 is mounted to the hinge stile 116 so that the at least one common pivot axis 212 is interiorly adjacent to the outer leaf panel 120 of the security door assembly 100. Alternatively, the common pivot axis 212 may be in line with or exteriorly offset from the plane of the outer leaf panel 120. A door leaf support bracket 218 is operably mounted to the hinge stile 116 of the door leaf assembly 102, 104 and further coupled to the an inner door leaf flange 220 of the inner door leaf 118, so as to support the inner door leaf flange 220 and conceal/prevent any access or gaps between the hinge mount bracket 202 and door leaf assembly 102, 104, when the door leaf assembly 102, 104 is in a closed position.

In one embodiment, the inner door leaf flange 220 and the outer door leaf panel flange 208 may be separate members mountable to the door leaf assembly 102, 104. However, in another embodiment, the inner door leaf flange 220 and the outer door leaf panel flange 208 may be integral part of respective inner and outer door leaf panels 118 and 120 of the door leaf assembly 102, 104. In one embodiment, the body panel flange 206 may be a separate member operably mountable to the first or second jamb member 112, 114. In another alternative embodiment, the body panel flange 206 may be an integral part of a body panel mounted to the first or second jamb member 112, 114.

When the door leaf assembly 102, 104 is in the closed position, the body panel flange 206 overlaps with the outer door leaf panel flange 208 and a portion of the door leaf support bracket 218 (i.e. the flange portion coupled to the inner door leaf flange 220) overlaps with a portion of the hinge mount bracket 202, preventing or at least restricting any access to the hinge mechanism 210. During operation, for example, when moving the door leaf assembly 102, 104 from a first closed position to a second open position (see FIGS. 3 and 4), the outer door leaf panel flange 208 moves about the common pivot axis 212 into the hinge chamber 204 while continuing to conceal the hinge mechanism 210. At the same time, the inner door leaf flange 220 moves out of overlapping engagement with the hinge mount bracket 202 further restricting access to the hinge mechanism 210 up until the door leaf assembly 102, 104 is fully opened (see FIG. 4).

Consequently, it is not possible to attack the hinges on such a security door-set 100 without first attacking the outer door leaf assembly 102, 104. Here, concealment means that the door assembly 100 provides no clues about where best to start an attack. Therefore, a combination of this security hinge assembly 200 with, for example, a 'dogging' feature on each door 102, 104 offers an significantly improved protection to wedge-, lever-, crow-bar- and other attacks, because the concealing hinge action of the hinge assembly 200 has been designed to position the outer door leaf behind the front face of the door frame structure 106. This forces any attacker to cut significant amounts of steel simply to get access to the hinge mechanism 210, which in-turn gives no benefit anyway, because the hinges are actually redundant when the door 102, 104 is in its closed position. Furthermore, any hammering and wedging will not lead to access to the hinge mechanism 210, as the outer leaf panel 120 will continue to conceal the hinge, even when bent inwards (i.e. towards the hinge mechanism 210).

In particular, the hinge action positions the front of the outer door leaf panel 120 behind the frame structure 112, 114 over the entire length of the door 100. Therefore, the hinge assembly 200 of the present invention provides another significant advantage by moving the door into the closed position through an arc that guides the reinforced inner leaf panel flange 220 (reinforced by the door leaf support bracket 218) to 'wrap' around the rear of the hinge mount bracket 202 (part of the frame structure 106). As this occurs over the entire length of the door 100, it is likely to significantly frustrate any attacker by adding yet more defensive layers to the security door system 100.

The hinge design of the invention can support use in a variety of security categories (such as LPC 1175 SR 2 to 5) in that the resistance of the hinge to attack at higher attack levels may be achieved by incrementally increasing the integrity of the material shrouding the hinge.

Figure 6:
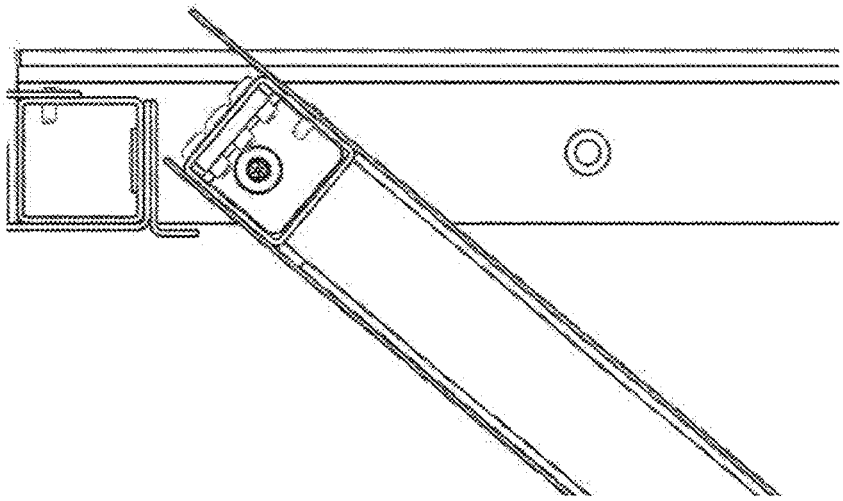
FIG. 6 shows a cross-section top-view of a portion of the frame structure, hinge assembly and door leaf of a further embodiment in a half-open position.
Figure 7:
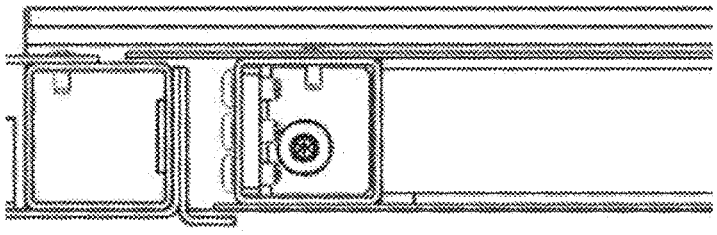
FIG. 7 shows a cross-section top-view of a portion of the frame structure, hinge assembly and door leaf of FIG. 6 in a fully-closed position.

An alternative arrangement, in which the hinge in held in a closed hinge chamber, is shown in FIGS. 6 and 7.

In this embodiment, the hinge action positions the front of the outer door leaf behind the frame section over the entire length of the door. The hinge action brings another significant feature to the product by carrying the door into the closed position through an arc that guides the reinforced inner leaf to 'wrap' around the rear of the door frame. Since this occurs over the entire length of the door it significantly frustrates attacks by adding defensive layers to the door set.

The figures show the action of the door as it moves into the closed position and the overlap 'dogging' shown in the closed position runs the full length of the profile.

This arrangement means that as all hinge fixings are concealed from the attack surface by significant amounts of steel that simply getting into a position where an attack could be started is very difficult.

It will be appreciated by persons skilled in the art that the above embodiment(s) has been described by way of example only and not in any Limitative sense, and that various alterations and modifications are possible without departing from the scope of the invention as defined by the appended claims.

The invention claimed is:

1. A security door hinge assembly comprising:

a door frame structure, having at least a head member, a first jamb member and a second jamb member;

at least one door leaf comprising:

a leaf frame structure, having at least a top rail member, a bottom rail member, a hinge stile member and a second stile member;

an inner leaf panel, mounted to a first side of the leaf frame structure and extending past the hinge stile member, so as to form an inner leaf flange;

an outer leaf panel, mounted to a second side of the leaf frame structure, opposite the first side, and extending past the hinge stile member, so as to form an outer leaf flange; and wherein, in use, the door leaf is operable between a first closed position and a second open position;

at least one body panel, mounted to the first jamb member and extending past the first jamb member, so as to form a body panel flange;

a hinge-mount bracket, coupled to the first jamb member so as to form an open or closed hinge chamber in conjunction with said body panel flange between said first jamb member and said hinge stile;

a hinge mechanism, having at least one pivot axis and which is located within the hinge chamber and adapted to pivotally mount the door leaf to the hinge-mount bracket; and wherein, in the first closed position, the outer leaf flange is in an interiorly overlapping engagement with the body panel flange and the inner leaf flange is in an exteriorly overlapping engagement with at least a portion of the hinge mount bracket, so as to prevent access to the hinge mechanism.

2. The security door hinge assembly according to claim 1, wherein the body panel is arranged in a first plane defined by a lateral outer surface of the door frame structure.

3. The security door hinge assembly according to claim 2, wherein the outer leaf panel and extending outer leaf flange are arranged in a second plane that is parallel to and inwardly offset from the first plane.

4. The security door hinge assembly according to claim 3, wherein the at least one pivot axis of the hinge mechanism is located substantially in the second plane of the outer leaf flange.

5. The security door hinge assembly according to claim 4, wherein the at least one pivot axis of the hinge mechanism is located in a plane adjacent to the second plane.

6. The security door hinge assembly according to claim 5, wherein the at least one pivot axis of the hinge mechanism is located in a plane parallel to and exteriorly offset from the second plane.

7. The security door hinge assembly according to claim 1, further comprising a door leaf support bracket that is operably coupled to the leaf frame structure and the inner leaf flange, and which is adapted to structurally support the inner leaf flange.

8. The security door hinge assembly according to claim 7, wherein the hinge mechanism is operably coupled to the leaf frame structure via the door leaf support bracket.

9. The security door hinge assembly according to claim 1, wherein the outer leaf flange is adapted to freely move within the open hinge chamber when the door leaf is moved between the first closed position and the second open position.

10. The security door hinge assembly according to claim 1, wherein the outer leaf flange has a length that is sufficient to continually conceal the hinge mechanism, when the door leaf is moved between the first closed position and the second open position.

11. The security door hinge assembly according to claim 1, wherein the body panel flange, the outer leaf flange and the inner leaf flange are separate members, the body panel flange is operably mountable to the first and second jamb member, and each one of the outer and inner leaf flange is operably mountable to a respective side of the leaf frame structure.

* * * * *